US005201965A

United States Patent [19]

Ohtsuka et al.

[11] Patent Number: 5,201,965

[45] Date of Patent: Apr. 13, 1993

[54] HEAT-RESISTANT CAST STEEL, METHOD OF PRODUCING SAME, AND EXHAUST EQUIPMENT MEMBER MADE THEREOF

[75] Inventors: Koki Ohtsuka, Mouka; Norio Takahashi, Oomiya, both of Japan

[73] Assignee: Hitachi Metals, Ltd., Tokyo, Japan

[21] Appl. No.: 868,120

[22] Filed: Apr. 14, 1992

[30] Foreign Application Priority Data

Apr. 15, 1991 [JP] Japan ..... 3-109819

[51] Int. Cl.[5] ..... C22C 38/34

[52] U.S. Cl. ..... 148/333; 420/114; 164/131; 164/76.1; 428/685

[58] Field of Search ..... 164/131, 132, 76.1; 428/685; 60/909; 416/241 R; 148/333; 420/114, 117

[56] References Cited

U.S. PATENT DOCUMENTS

| | | | |
|---|---|---|---|
| 1,456,088 | 5/1923 | Armstrong | 420/104 |
| 2,750,283 | 6/1956 | Loveless | 148/327 |
| 2,801,916 | 8/1957 | Harris | 420/53 |
| 4,129,442 | 12/1978 | Horiuchi et al. | 420/110 |
| 4,790,977 | 12/1988 | Daniels et al. | 420/104 |
| 5,096,514 | 3/1992 | Watanabe et al. | 148/325 |
| 5,102,479 | 4/1992 | Nakamura et al. | 148/333 |
| 5,106,578 | 4/1992 | Ohtsuka et al. | 420/68 |

FOREIGN PATENT DOCUMENTS

| | | | |
|---|---|---|---|
| 212628 | 12/1955 | Australia . | |
| 57-8183 | 2/1957 | Japan . | |
| 57-16114 | 1/1982 | Japan | 148/333 |
| 60-255957 | 12/1985 | Japan | 148/333 |
| 61-87852 | 6/1986 | Japan . | |
| 61-177352 | 8/1986 | Japan . | |
| 310888 | 1/1956 | Sweden . | |
| 297485 | 3/1954 | Switzerland . | |
| 658115 | 10/1949 | United Kingdom . | |
| 669579 | 4/1952 | United Kingdom . | |
| 675809 | 7/1952 | United Kingdom . | |
| 746472 | 3/1956 | United Kingdom . | |

*Primary Examiner*—Deborah Yee

*Attorney, Agent, or Firm*—Finnegan, Henderson, Farabow, Garrett & Dunner

[57] ABSTRACT

A heat-resistant cast steel having a metal matrix substantially consisting of a ferrite phase and a pearlitic-colony phase has a composition consisting essentially, by weight, of C: 0.05–0.25%, Si:2.5–3.5%, Mn:2% or less, Cr:4–8%, N:0.05% or less, and Fe and inevitable impurities: balance, as well as at least one selected from the group consisting of (i) W and/or Co:0.1–2%, (ii) a rare earth element and/or Y:0.1% or less, (iii) Mg and/or Ca:0.005–0.03%, and (iv) B:0.001–0.01%.

27 Claims, 4 Drawing Sheets

( × 100)

( × 100)

( × 100)

(× 100)

(× 100)

HEAT-RESISTANT CAST STEEL, METHOD OF PRODUCING SAME, AND EXHAUST EQUIPMENT MEMBER MADE THEREOF

BACKGROUND OF THE INVENTION

The present invention relates to a heat-resistant cast steel excellent in oxidation resistance, thermal crack resistance, heat deformation resistance, etc. as well as castability and workability, and a process of producing such a heat-resistant cast steel, and parts such as combustion chambers and exhaust equipment members for internal-combustion engines which are made of such heat-resistant cast steel.

Generally, materials composing parts for exhaust equipment members and combustion chambers of gasoline engines and diesel engines of automobiles are empirically selected, by considering the temperature of exhaust gas at a full-load operation of engines, the total exhaust gas energy determined by the temperature of exhaust gas and the amount of exhaust gas emitted per hour, the shapes of parts, constraint conditions for parts, and heat capacities of parts for exhaust gas-cleaning members which determine the time to reach the activation temperature of exhaust gas-cleaning catalytic converters from the cold-start of engines, etc.

Since exhaust equipment members for automobiles, for instance, prechambers, port liners, exhaust manifolds, turbocharger housings, exhaust outlets connected right under turbochargers, and parts for exhaust gas-cleaning members such as exhaust gas-cleaning catalytic converters, etc. are likely to be oxidized or subjected to thermal stress when operated at an extremely high temperature, materials having relatively good heat resistance, such as high-Si spheroidal graphite cast iron, austenite spheroidal graphite cast iron containing a large amount of Ni, and in a few cases a heat-resistant austenite cast steel SCH12 have been employed conventionally.

Particularly in case where the temperature of exhaust gas at a full-load operation is 900° C. or lower, high-Si spheroidal graphite cast iron and FCD400 (JIS Standard) cast iron, etc. are mainly employed for exhaust manifolds for engines of an uncontrolled air intake-type, exhaust gas-cleaning catalytic converter containers connected to the outlets of the exhaust manifolds, etc. Also, high-Si spheroidal graphite cast iron and austenite spheroidal graphite cast iron are employed for exhaust manifolds for supercharger-equipped engines and turbocharger housings, etc. in view of functional requirements for these parts. In the latter case, high-Si spheroidal graphite cast iron, FCD400 (JIS Standard) cast iron, etc. are mainly employed for exhaust gas-cleaning catalytic converter containers connected to the outlets of the turbocharger housings.

On the other hand, in the case of super high-performance engines with which the temperature of exhaust gas at a full-load operation exceeds 900° C., austenite spheroidal graphite cast iron and a high-alloy, heat-resistant, ferritic cast steel are employed for exhaust manifolds for supercharger-equipped engines, and in some cases austenite spheroidal graphite cast iron is also employed for exhaust manifolds for high-performance engines of an uncontrolled air intake-type. Also, a high-alloy, heat-resistant, ferritic or austenite cast steel has become adopted for turbocharger housings of such super high-performance engines.

However, because of the recent strict regulations of the emission of exhaust gas, further improvement of the efficiency of the purification of exhaust gas at the cold-start of engines has been required. To fulfill this objective, it is necessary to reduce the heat capacity of each member from an exhaust manifold to an exhaust gas-cleaning catalytic converter equipment, so that the temperature of the catalytic converter can reach its activation point as soon as possible after the cold-start of an engine. Also, in order to improve the fuel efficiency and to decrease the amount of $CO_2$ emitted, it is necessary to make parts of automobiles including engine parts extremely light and to improve the energy efficiency by high-temperature combustion.

For this purpose, exhaust parts constituted by thin and light welded pipes have lately been produced by pressing or bending rolled sheets or pipes made of ferritic stainless steel such as SUS410, SUS430, etc. and afterwords by welding them, and such exhaust parts have become popular. However, since such parts having welded structures, for example, pipe-gathering portions of exhaust manifolds, have complicated structures, their production costs are so high. In addition, since such parts are subjected to great thermal stress in many cases, it is difficult to obtain the parts having good durability (such as heat deformation resistance, thermal crack resistance, etc.).

Therefore, in order to solve such a problem on parts which are difficult to form and weld, exhaust equipment members consisting of cast parts having complicated shapes and made of a so-called high-alloy, heat-resistant cast steel described above and bent pipes welded to the cast parts are employed in some cases.

For example, in the case of an engine of an uncontrolled air intake-type, as is shown in FIG. 6, a smaller exhaust gas-cleaning catalytic equipment (a secondary catalytic converter) 4 effective for a cold-start is fitted directly to the exhaust manifold 1, and a bigger exhaust gas-cleaning catalytic equipment (a primary catalytic converter) 7 is disposed on the downstream side of the smaller catalytic equipment 4. The secondary catalytic converter container 4 is welded to the downstream end of the exhaust manifold 1, and the primary catalytic converter container 7 is welded to a front tube 6 which in turn is welded to the downstream end of the secondary catalytic converter 4. Because of such a layout, a thermal capacity (thermal inertia) of the whole exhaust equipment member decreases, and heat is hardly taken away from the exhaust gas on its way. Therefore, a capacity for the purification of exhaust gas by a catalyst at a cold-start increases remarkably.

Since the exhaust gas at a high temperature exceeding 900° C. passes through these parts of the exhaust equipment at a full-load operation of an engine, it is strongly desired that the parts of the exhaust equipment should have excellent heat resistance (oxidation resistance, thermal crack resistance, and heat deformation resistance).

In the background described above, U.S. Pat. No. 4,790,977 discloses as an alloyed steel which has excellent oxidation resistance and creep strength at a high temperature, an alloyed steel consisting of a ferrite phase and having a composition consisting essentially, by weight, of:

C: about 0.01–0.3%,
Mn: about 2% or less,
Si: over 2.35% and up to about 4%,
Cr: about 3–7%, Ni: about 1% or less,
N: about 0.15% or less,
Al: less than 0.3%,
at least one element for forming carbide and nitride (Nb, Ta, V, Ti, Zr): 1.0% or less,
Mo: up to 2%, and
Fe and inevitable impurities: balance.

However, it turns out that such an alloyed steel consisting of a ferrite phase does not always exhibit sufficient heat resistance, particularly heat deformation resistance when exposed to a high temperature of 800° C. or higher.

OBJECT AND SUMMARY OF THE INVENTION

Therefore, an object of the present invention is to provide a cast steel having excellent heat resistance such as heat deformation resistance, thermal crack resistance, oxidation resistance, etc. at an exhaust gas temperature of 800° C. or higher, specifically 900°-950° C., and at the same time being excellent in castability, workability and weldability and being produced at a low cost.

Another object of the present invention is to provide a method of producing such a heat-resistant cast steel.

A further object of the present invention is to provide an exhaust equipment member made of such a heat-resistant cast steel.

As a result of intense research in view of the above objects, the inventors have found that a pearlitic-colony phase should be formed in an alloy matrix for the improvement of heat deformation resistance, and that not only by forming an alloy matrix consisting essentially of a ferrite phase and a pearlitic-colony phase by avoiding the addition of elements inhibiting the formation of the pearlitic-colony phase, but also by adding one or more of (a) W and/or Co, (b) a rare earth element and/or Y, (c) Mg and/or Ca, and (d) B, a heat-resistant cast steel which meets the above requirements of heat resistance can be obtained. Specifically, to obtain these properties, an area ratio of the colony phase in the alloy matrix needs to be approximately 15% or more. The present invention has been completed based upon these findings.

Thus, the heat-resistant cast steel according to the first embodiment of the present invention has a metal matrix substantially consisting of a ferrite phase and a pearlitic-colony phase, and has a composition consisting essentially, by weight, of:

C: 0.05-0.25%,
Si: 2.5-3.5%,
Mn: 2% or less,
Cr: 4-8%,
N: 0.05% or less,
W and/or Co: 0.1-2%, and
Fe and inevitable impurities: balance.

The word "substantially" used herein implies that the metal matrix at a room temperature consists essentially of a pearlitic-colony phase having a eutectoid structure composed of metal-carbon compounds such as $M_{23}C_6$, etc. and a ferrite, and a ferrite phase, with metal compounds or inclusions permitted to exist in these phases. The same is true with respect to the heat-resistant cast steels of the second to tenth embodiments of the present invention which will be described below.

The heat-resistant cast steel according to the second embodiment of the present invention has a metal matrix substantially consisting of a ferrite phase and a pearlitic-colony phase, and has a composition consisting essentially, by weight, of:

C: 0.05-0.25%,
Si: 2.5-3.5%,
Mn: 2% or less,
Cr: 4-8%,
N: 0.05% or less,
Rare earth element and/or Y: 0.1% or less, and
Fe and inevitable impurities: balance.

The heat-resistant cast steel according to the third embodiment of the present invention has a metal matrix substantially consisting of a ferrite phase and a pearlitic-colony phase, and has a composition consisting essentially, by weight, of:

C: 0.05-0.25%,
Si: 2.5-3.5%,
Mn: 2% or less,
Cr: 4-8%,
N: 0.05% or less,
Mg and/or Ca: 0.005-0.03%, and
Fe and inevitable impurities: balance.

The heat-resistant cast steel according to the fourth embodiment of the present invention has a metal matrix substantially consisting of a ferrite phase and a pearlitic-colony phase, and has a composition consisting essentially, by weight, of:

C: 0.05-0.25%,
Si: 2.5-3.5%,
Mn: 2% or less,
Cr: 4-8%,
N: 0.05% or less,
B: 0.001-0.01%, and
Fe and inevitable impurities: balance.

The heat-resistant cast steel according to the fifth embodiment of the present invention has a metal matrix substantially consisting of a ferrite phase and a pearlitic-colony phase, and has a composition consisting essentially, by weight, of:

C: 0.05-0.25%,
Si: 2.5-3.5%,
Mn: 2% or less,
Cr: 4-8%,
N: 0.05% or less,
W and/or Co: 0.1-2%,
Rare earth element and/or Y: 0.1% or less, and
Fe and inevitable impurities: balance.

The heat-resistant cast steel according to the sixth embodiment of the present invention has a metal matrix substantially consisting of a ferrite phase and a pearlitic-colony phase, and has a composition consisting essentially, by weight, of:

C: 0.05-0.25%,
Si: 2.5-3.5%,
Mn: 2% or less,
Cr: 4-8%,
N: 0.05% or less,
W and/or Co: 0.1-2%,
Mg and/or Ca: 0.005-0.03%, and
Fe and inevitable impurities: balance.

The heat-resistant cast steel according to the seventh embodiment of the present invention has a metal matrix substantially consisting of a ferrite phase and a pearlitic-colony phase, and has a composition consisting essentially, by weight, of:

C: 0.05-0.25%,
Si: 2.5-3.5%,
Mn: 2% or less,
Cr: 4-8%,

N: 0.05% or less,
W and/or Co: 0.1–2%,
B: 0.001–0.01%, and
Fe and inevitable impurities: balance.

The heat-resistant cast steel according to the eighth embodiment of the present invention has a metal matrix substantially consisting of a ferrite phase and a pearlitic-colony phase, and has a composition consisting essentially, by weight, of:

C: 0.05–0.25%,
Si: 2.5–3.5%,
Mn: 2% or less,
Cr: 4–8%,
N: 0.05% or less,
W and/or Co: 0.1–2%,
Rare earth element and/or Y: 0.1% or less,
Mg and/or Ca: 0.005–0.03%, and
Fe and inevitable impurities: balance.

The heat-resistant cast steel according to the ninth embodiment of the present invention has a metal matrix substantially consisting of a ferrite phase and a pearlitic-colony phase, and has a composition consisting essentially, by weight, of:

C: 0.05–0.25%,
Si: 2.5–3.5%,
Mn: 2% or less,
Cr: 4–8%,
N: 0.05% or less,
W and/or Co: 0.1–2%,
Rare earth element and/or Y: 0.1% or less,
B: 0.001–0.01%, and
Fe and inevitable impurities: balance.

The heat-resistant cast steel according to the tenth embodiment of the present invention has a metal matrix ferrite phase and a pearlitic-colony phase, and has a composition consisting essentially, by weight, of:

C: 0.05–0.25%,
Si: 2.5–3.5%,
Mn: 2% or less,
Cr: 4–8%,
N: 0.05% or less,
W and/or Co: 0.1–2%,
Rare earth element and/or Y: 0.1% or less,
Mg and/or Ca: 0.005–0.03%,
B: 0.001–0.01%, and
Fe and inevitable impurities: balance.

The process for producing the heat-resistant cast steel according to the present invention comprises the steps of pouring a molten metal having the above composition after solidification into a sand mold under reduced pressure or into a precision casting mold, cooling it spontaneously in the mold until the temperature of the hottest part of the cast product gets down to 900° C. or lower, and then shaking the resulting case product out of the mold, whereby a metal matrix of the resulting cast product at a room temperature consists essentially of a pearlitic-colony phase having a eutectoid structure composed of metal-carbon compounds such as $M_{23}C_6$, etc. and a ferrite, and a ferrite phase, with metal compounds and/or inclusions contained in these phases.

The exhaust equipment member for internal combustion engines according to the present invention, which is to be exposed to hot combustion gas or exhaust gas at a temperature of 800° C. or higher, is at least partially made of the above heat-resistant cast steel.

DETAILED DESCRIPTION OF THE INVENTION

Figure 1:
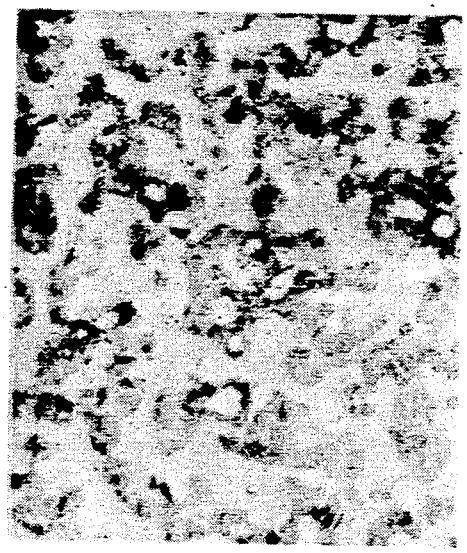
FIG. 1 is a photomicrograph (100×) showing a metal matrix in an as-cast state of the heat-resistant cast steel of Example 2 shown in Table 1.

The present invention will be explained in detail below.

First, the reasons for restricting the composition range of each alloy element in the heat-resistant cast steel of the present invention will be explained below.

(a) C: 0.05–0.25 weight %

C is an essential element influencing heat fatigue properties such as heat deformation resistance, etc. under the thermal strain conditions. Generally, as a carbon content increases, the tensile strength and creep strength of the cast steel increase. On the other hand, for excellent weldability, it is required that the welding boundaries of the cast steel have as low hardness as possible. When the carbon content is less than 0.05 weight %, the heat deformation properties of the cast steel drastically deteriorate. For heat deformation resistance, an area ratio of the colony phase needs to be about 15% or more. Therefore, the minimum carbon content should be 0.05 weight %. However, when the amount of carbon exceeds 0.25 weight %, the carbon dissolves into a metal matrix, forming excess carbides with Cr, W, etc., which are elements effective for improving the oxidation resistance of the cast steel. This leads to the deterioration of the oxidation resistance which is an important property for the cast steel to be a heat-resistant material. Also, when the amount of carbon exceeds 0.25 weight %, on as-cast matrix is no longer a mixture of a ferrite phase and a pearlitic-colony phase, and an $A_1$ transformation temperature of the cast steel becomes lower than 850° C., leading to the shortening of a thermal fatigue life. Accordingly, the amount of carbon needs to be 0.25 weight % or less.

Incidentally, in order to have good heat deformation resistance, the amount of C is desirably about 0.12 weight % or more. On the other hand, with respect to parts whose weldability is primarily important even with a high-temperature strength sacrificed to some extent, the preferred amount of C is 0.05–0.12 weight %. Also, with respect to parts whose heat deformation resistance is primarily important, the preferred amount of C is 0.12–0.18 weight %.

(b) Si: 2.5–3.5 weight %

Si increases an $A_1$ transformation temperature to a higher level and is also effective for improving the oxidation resistance of the cast steel. In addition, Si is effective for improving castability and has a function as a deoxidizer. Also, Si is effective for decreasing voids (gas defects) of a cast product. To exhibit such functions effectively, the amount of Si should be 2.5 weight % or more. On the other hand, when Si is excessively dissolved into a ferrite matrix, it causes the deterioration of the toughness and weldability of the cast steel. Accordingly, the upper limit of Si is 3.5 weight %. The preferred amount of Si is 2.8–3.2 weight %.

(c) Mn: 2 weight % or less

Mn is effective like Si as a deoxidizer and also improves the fluidity of the melt at the time of casting, leading to the improvement of the productivity. However, when it exceeds 2 weight %, the cast iron becomes brittle. Accordingly, the preferred amount of Mn is 0.2–0.8 weight %.

(d) Cr: 4–8 weight %

Cr is an important element in the present invention since it improves oxidation resistance like Si and increases an $A_1$ transformation temperature of the cast steel. Since the oxidation resistance of the cast iron of the present invention needs to be better than that of the high-Si spheroidal graphite cast iron and the austenite spheroidal graphite cast iron, which are to be replaced by the cast iron of the present invention, the amount of Cr should be 4 weight % or more, considering the amount of Si. Also, when it exceeds 8 weight %, the fluidity and castability are deteriorated.

(e) N: 0.05 weight % or less

N is an element effective for improving the high-temperature strength of the cast steel like C. However, when it is dissolved into a molten metal in an amount exceeding 0.05 weight %, gas defects such as pin halls, etc. are induced at the time of solidification, resulting in failure to the stable production of high-quality cast products. Therefore, for the stable production of the cast steel, the amount of N should be 0.05 weight % or less.

The heat-resistant cast steel of the first embodiment of the present invention contains W and/or Co in addition to the above basic components.

(f) W and/or Co: 0.1–2 weight %

W and/or Co have a function of improving mechanical properties such as tensile strength, etc. at a high temperature as a solid solution strengthening element. To exhibit such an effect effectively, the amount of W and/or Co should be at least 0.1 weight %. On the other hand, if they are excessively added, the elongation of the cast steel decreases on the lower side of a usual operation temperature (less than 150° C.), causing a welding crack. Accordingly, the upper limit of W and/or Co is 2 weight %. When both W and Co are added, their total amount should be 0.1–2 weight %. The preferred amount of W and/or Co is 0.2–0.8 weight %.

The heat-resistant cast steel of the second embodiment of the present invention has a metal matrix consisting essentially of ferrite phase and a pearlitic-colony phase, and has a composition consisting essentially, by weight, of:

C: 0.05–0.25%,
Si: 2.5–3.5%,
Mn: 2% or less,
Cr: 4–8%,
N: 0.05% or less,
Rare earth element and/or Y: 0.1% or less, and
Fe and inevitable impurities: balance.

The heat-resistant cast steel of the second embodiment is characterized by containing a rare earth element and/or Y as described below. As rare earth elements, La, Ce, Nd, Pr, Sm, etc. are preferable. Particularly, a Misch metal which mainly contains La and Ce is preferable because of low cost. With respect to the other elements, their composition ranges are the same as those of the cast steel of the first embodiment.

(g) Rare earth element and/or Y: 0.1 weight % or less

A rare earth element and/or Y has a function of improving the oxidation resistance of the cast steel at a high temperature. However, even if the amount of the rare earth element, etc. exceeds 0.1 weight %, further improvement cannot be achieved. Accordingly, the upper limit of the rare earth element and/or Y is 0.1 weight %. Incidentally, the lower limit of the rare earth element and/or Y is preferably 0.05 weight %. If the amount of the rare earth element and/or Y is lower than 0.005 weight %, the effects of adding the rare earth element and/or Y can hardly be achieved.

The heat-resistant cast steel according to the third embodiment of the present invention has a metal matrix substantially consisting of a ferrite phase and a pearlitic-colony phase, and has a composition consisting essentially, by weight, of:

C: 0.05–0.25%,
Si: 2.5–3.5%,
Mn: 2% or less,
Cr: 4–8%,
N: 0.05% or less,
Mg and/or Ca: 0.005–0.03%, and
Fe and inevitable impurities: balance.

The heat-resistant cast steel of the third embodiment is characterized by containing Mg and/or Ca as an indispensable element as described below. With respect to the other components, the heat-resistant cast steel of the third embodiment is not different from that of the first embodiment.

(h) Mg and/or Ca: 0.005–0.03 weight %

Mg and/or Ca has a function of improving the elongation of the cast steel by making inclusions spheroidal, as well as a function of deoxidation and desulfurization. The inclusions are compounds comprising Si, Mn, etc., for instance, compounds of metal elements such as Mg, Si, Mn, Al, etc. and O or S, that is, oxides or sulfides. When the amount of Mg and/or Ca is less than 0.005 weight %, the sufficient effect cannot be achieved. On the other hand, when it exceeds 0.03 weight %, it leads to the embrittlement of the cast steel. Incidentally, when both Mg and Ca are added, the total amount of Mg and Ca should be within the range of 0.005–0.03 weight %. The preferred amount of Mg and/or Ca is 0.015–0.02 weight %.

The heat-resistant cast steel according to the fourth embodiment of the present invention has a metal matrix substantially consisting of a ferrite phase and a pearlitic-colony phase, and has a composition consisting essentially, by weight, of:

C: 0.05–0.25%,
Si: 2.5–3.5%,
Mn: 2% or less,
Cr: 4–8%,
N: 0.05% or less,

B: 0.001–0.01%, and
Fe and inevitable impurities: balance.

The heat-resistant cast steel of the fourth embodiment is characterized by containing B as an indispensable element as described below. With respect to the other components, the heat-resistant cast steel of the fourth embodiment is not different from that of the first one.

(i) B: 0.001–0.01%

B has a function of strengthening the crystal grain boundaries of the cast steel and making carbides in the grain boundaries finer and further deterring the agglomeration and growth of such carbides, thereby improving the high-temperature strength and toughness of the cast steel. Accordingly, the amount of B is 0.001 weight % or more. However, if it is excessively added, borides are precipitated, leading to poor high-temperature strength. Thus, the upper limit of B is 0.01 weight %. The preferred amount of B is 0.005–0.01 weight %.

The heat-resistant cast steel according to the fifth embodiment of the present invention has a metal matrix substantially consisting of a ferrite phase and a pearlitic-colony phase, and has a composition consisting essentially, by weight, of:

C: 0.05–0.25%,
Si: 2.5–3.5%,
Mn: 2% or less,
Cr: 4–8%,
N: 0.05% or less,
W and/or Co: 0.1–2%,
Rare earth element and/or Y: 0.1% or less, and
Fe and inevitable impurities: balance.

Since the heat-resistant cast steel of the fifth embodiment contains both of (i) W and/or Co and (ii) a rare earth element and/or Y, it is excellent in high-temperature strength and oxidation resistance. Incidentally, with respect to the amounts of W and/or Co and the rare earth element and/or Y, the numerical limitations described above are applied. With respect to the other components, the heat-resistant cast steel of the fifth embodiment is the same as that of the first embodiment.

The heat-resistant cast steel according to the sixth embodiment of the present invention has a metal matrix substantially consisting of a ferrite phase and a pearlitic-colony phase, and has a composition consisting essentially, by weight, of:

C: 0.05–0.25%,
Si: 2.5–3.5%,
Mn: 2% or less,
Cr: 4–8%,
N: 0.05% or less,
W and/or Co: 0.1–2%,
Mg and/or Ca: 0.005–0.03%, and
Fe and inevitable impurities: balanced.

Since the heat-resistant cast steel of the sixth embodiment contains both of (i) W and/or Co and (ii) Mg and/or Ca, it is excellent in high-temperature strength and toughness. Incidentally, with respect to the amounts of W and/or Co and Mg and/or Ca, the numerical limitations described above are applied. With respect to the other components, the heat-resistant cast steel of the sixth embodiment is the same as that of the first embodiment.

The heat-resistant cast steel according to the seventh embodiment of the present invention has a metal matrix substantially consisting of a ferrite phase and a pearlitic-colony phase, and has a composition consisting essentially, by weight, of:

C: 0.05–0.25%,
Si: 2.5–3.5%,
Mn: 2% or less,
Cr: 4–8%,
N: 0.05% or less,
W and/or Co: 0.1–2%,
B: 0.001–0.01%, and
Fe and inevitable impurities: balance.

Since the heat-resistant cast steel of the seventh embodiment contains both of W and/or Co and B, it is excellent in high-temperature strength and toughness. Incidentally, with respect to the amounts of W and/or Co and B, the numerical limitations described above are applied. With respect to the other components, the heat-resistant cast steel of the seventh embodiment is the same as that of the first embodiment.

The heat-resistant cast steel according to the eighth embodiment of the present invention has a metal matrix substantially consisting of a ferrite phase and a pearlitic-colony phase, and has a composition consisting essentially, by weight, of:

C: 0.05–0.25%,
Si: 2.5–3.5%,
Mn: 2% or less,
Cr: 4–8%,
N: 0.05% or less,
W and/or Co: 0.1–2%,
Rare earth element and/or Y: 0.1% or less,
Mg and/or Ca: 0.005–0.03%, and
Fe and inevitable impurities: balance.

Since the heat-resistant cast steel of the eighth embodiment contains (i) W and/or Co, (ii) a rare earth element and/or Y, and (iii) Mg and/or Ca at the same time, it is excellent in high-temperature strength, toughness and oxidation resistance. Incidentally, with respect to the amounts of W and/or Co, the rare earth element and/or Y, and Mg and/or Ca, the numerical limitations described above are applied. With respect to the other components, the heat-resistant cast steel of the eighth embodiment is the same as that of the first embodiment.

The heat-resistant cast steel according to the ninth embodiment of the present invention has a metal matrix substantially consisting of a ferrite phase and a pearlitic-colony phase, and has a composition consisting essentially, by weight, of:

C: 0.05–0.25%,
Si: 2.5–3.5%,
Mn: 2% or less,
Cr: 4–8%,
N: 0.05% or less,
W and/or Co: 0.1–2%,
Rare earth element and/or Y: 0.1% or less,
B: 0.001–0.01%, and
Fe and inevitable impurities: balance.

Since the heat-resistant cast steel of the ninth embodiment contains (i) W and/or Co, (ii) the rare earth elements and/or Y, and (iii) B at the same time, it is excellent in high-temperature strength, toughness, and oxidation resistance. Incidentally, with respect to the amounts of W and/or Co, the rare earth element and/or Y, and B, the numerical limitations described above are applied. With respect to the other components, the heat-resistant cast steel of the ninth embodiment is the same as that of the first embodiment.

The heat-resistant cast steel according to the tenth embodiment of the present invention has a metal matrix substantially consisting of a ferrite phase and a pearlitic-colony phase, and has a composition consisting essentially, by weight, of:

C: 0.05–0.25%,
Si: 2.5–3.5%,
Mn: 2% or less,
Cr: 4–8%,
N: 0.05% or less,
W and/or Co: 0.1–2%,
Rare earth element and/or Y: 0.1% or less,
Mg and/or Ca: 0.005–0.03%,
B: 0.001–0.01%, and
Fe and inevitable impurities: balance.

Since the heat-resistant cast steel of the tenth embodiment contains (i) W and/or Co, (ii) the rare earth element and/or Y, (iii) Mg and/or Ca, and (iv) B at the same time, it is excellent in high-temperature strength, toughness and oxidation resistance. Incidentally, with respect to the amounts of W and/or Co, the rare earth element and/or Y, Mg and/or Ca, and B, the numerical limitations described above are applied. With respect to the other components, the heat-resistant cast steel of the tenth embodiment is the same as that of the first embodiment.

The heat-resistant cast steel of the present invention having each of the above compositions can be produced by pouring a molten metal having each of the above compositions into a sand mold under reduced pressure or into a precision casting mold, cooling the metal spontaneously in the mold mentioned above until the temperature of the hottest part of the resulting cast product gets down to 900° C. or lower, and shaking it out.

When the molten metal is poured into a mold at a room temperature, it should be done under reduced pressure. Since the molten metal having such a composition as to provide the cast product of the above composition has relatively low fluidity, the above procedure is essential to the production of extremely thin exhaust equipment members having high quality. The reduced pressure is generally set between about 5 kPa and about 40 kPa.

The shake-out temperature is 900° C. or lower in the hottest part of the cast product. If it exceeds 900° C., a metal matrix becomes a hard sorbitic phase by rapid cooling, so that the cast steel having desirable properties cannot be obtained.

The cast articles produced from the heat-resistant cast steel by the above process can be made as thin as 3 mm or less in their substantial portions. As described above, in order to decrease the heat capacity (thermal inertia) of the exhaust equipment members, the thinning of the heat-resistant cast products is crucial.

The cast products made of the heat-resistant cast steel of the present invention have remarkably good heat resistance. With respect to oxidation resistance, a weight loss by oxidation is 0.003 g/cm$^2$ or less when the cast products are kept at 900° C. for 200 hours in the air. Also, the heat-resistant cast steel of the present invention is excellent in thermal crack resistance and heat deformation resistance in a thermal fatigue cycle where heating and cooling are repeated between 900° C. and a room temperature. In addition, even though exhaust equipment members are given such a vibration as caused when an engine runs normally, no crack by a thermal fatigue occurs in the exhaust equipment members. Furthermore, even in a state where a thermal strain is completely restrained, the heat-resistant cast steel is not subjected to an $A_1$ transformation at a temperature of 900° C. or lower, and so has excellent heat deformation resistance.

The present invention will be explained in further detail by way of the following Examples.

EXAMPLES 1–35, COMPARATIVE EXAMPLES 1–7, AND CONVENTIONAL EXAMPLES 8–12

The compositions of the heat-resistant cast steel of Examples (the present invention) are shown in Table 1. Also, the compositions of Comparative Examples and Conventional Examples are shown in Tables 2 and 3 for comparison. The test pieces of Comparative Examples in Table 2 were produced to confirm the superiority of the heat-resistant cast steel of the present invention. Also, the heat-resistant cast steel or cast iron of Conventional Example Nos. 8–12 shown in Table 3 are those employed in exhaust equipment members such as exhaust manifolds, turbocharger housings, etc. for automobiles. Specifically, Conventional Example 8 is high-Si, ferritic, spheroidal graphite cast iron, Conventional Example 9 is austenite spheroidal graphite cast iron, Conventional Example 10 is heat-resistant, ferritic cast steel equivalent to JIS SCH1, and Conventional Examples 11 and 12 are heat-resistant, ferritic cast steels disclosed by U.S. Pat. No. 4,790,977. In Tables 1–3, the mark "-" means that components were not analyzed.

Alloy melts were produced in the air by using a high-frequency furnace of a 100-kg capacity, poured out of the furnace at 1550° C., and molded into Y-block test pieces (No. B according to JIS) at 1500° C. or higher by a $CO_2$—sand mold.

Then, the test pieces of the present invention prepared by the above process were subjected to a heat treatment comprising heating them at 800° C. for 2 hours in a furnace and spontaneously cooling them in the air.

On the other hand, the test pieces of Comparative Examples in Table 2 were subjected to the same heat treatment as above whenever necessary. Also, the test piece of Conventional Example 8 in Table 3 was used in an as-cast state for the tests. The test piece of Conventional Example 9 was subjected to a heat treatment comprising heating it at 900° C. for 2 hours in a furnace and spontaneously cooling it in the air. The test piece of Conventional Example 10 was subjected to a heat treatment comprising heating it at 920° C. for 2 hours in a furnace, cooling it down to 800° C. in the furnace, and spontaneously cooling it to room temperature in the air. Furthermore, the test pieces of Conventional Examples 11 and 12 were subjected to a heat treatment comprising heating them at 1120° C. for 2 hours in a furnace, cooling them down to 900° C. in the furnace, and spontaneously cooling them in the air.

TABLE 1

| Example | Chemical Component (Weight %) | | | | | | |
|---|---|---|---|---|---|---|---|
| No. | C | Si | Mn | P | S | Cr | N |
| 1 | 0.08 | 2.70 | 0.41 | 0.005 | 0.006 | 4.25 | 0.02 |
| 2 | 0.10 | 2.68 | 0.52 | 0.004 | 0.005 | 4.53 | 0.03 |
| 3 | 0.07 | 2.59 | 0.45 | 0.005 | 0.006 | 4.41 | 0.03 |
| 4 | 0.14 | 3.02 | 0.48 | 0.005 | 0.007 | 6.02 | 0.03 |
| 5 | 0.16 | 3.15 | 0.55 | 0.004 | 0.006 | 6.18 | 0.04 |
| 6 | 0.17 | 3.08 | 0.44 | 0.004 | 0.005 | 6.12 | 0.03 |
| 7 | 0.24 | 3.41 | 0.58 | 0.006 | 0.006 | 7.91 | 0.02 |
| 8 | 0.23 | 3.47 | 0.42 | 0.007 | 0.005 | 7.57 | 0.02 |
| 9 | 0.22 | 3.38 | 0.55 | 0.005 | 0.007 | 7.83 | 0.03 |
| 10 | 0.14 | 3.12 | 0.48 | 0.005 | 0.005 | 6.08 | 0.03 |
| 11 | 0.16 | 3.05 | 0.42 | 0.004 | 0.006 | 6.15 | 0.03 |
| 12 | 0.16 | 3.09 | 0.52 | 0.005 | 0.006 | 6.21 | 0.02 |
| 13 | 0.15 | 2.92 | 0.51 | 0.005 | 0.006 | 6.11 | 0.03 |
| 14 | 0.17 | 2.98 | 0.49 | 0.005 | 0.006 | 6.04 | 0.02 |
| 15 | 0.16 | 3.15 | 0.52 | 0.007 | 0.005 | 6.20 | 0.02 |
| 16 | 0.13 | 3.06 | 0.50 | 0.004 | 0.007 | 6.08 | 0.03 |

TABLE 1-continued

| | | | | | | | |
|---|---|---|---|---|---|---|---|
| 17 | 0.15 | 3.18 | 0.41 | 0.004 | 0.008 | 6.22 | 0.03 |
| 18 | 0.12 | 2.95 | 0.42 | 0.004 | 0.006 | 6.00 | 0.02 |
| 19 | 0.16 | 3.05 | 0.51 | 0.004 | 0.005 | 6.02 | 0.03 |
| 20 | 0.15 | 3.10 | 0.58 | 0.004 | 0.006 | 6.09 | 0.03 |
| 21 | 0.13 | 3.04 | 0.42 | 0.005 | 0.007 | 6.14 | 0.03 |
| 22 | 0.14 | 3.09 | 0.45 | 0.004 | 0.008 | 6.21 | 0.03 |
| 23 | 0.16 | 3.11 | 0.55 | 0.006 | 0.006 | 6.13 | 0.03 |
| 24 | 0.17 | 3.10 | 0.62 | 0.004 | 0.005 | 5.93 | 0.03 |
| 25 | 0.18 | 2.95 | 0.47 | 0.005 | 0.006 | 6.48 | 0.02 |
| 26 | 0.17 | 2.99 | 0.46 | 0.005 | 0.006 | 6.18 | 0.03 |
| 27 | 0.14 | 3.14 | 0.42 | 0.004 | 0.005 | 6.33 | 0.03 |
| 28 | 0.15 | 3.03 | 0.49 | 0.004 | 0.006 | 6.14 | 0.03 |
| 29 | 0.16 | 3.18 | 0.44 | 0.005 | 0.006 | 6.08 | 0.03 |
| 30 | 0.18 | 3.30 | 0.52 | 0.005 | 0.006 | 6.17 | 0.03 |
| 31 | 0.16 | 3.09 | 0.58 | 0.004 | 0.006 | 6.02 | 0.03 |
| 32 | 0.14 | 3.18 | 0.55 | 0.003 | 0.006 | 6.16 | 0.03 |
| 33 | 0.19 | 3.28 | 0.61 | 0.004 | 0.006 | 6.28 | 0.02 |
| 34 | 0.14 | 3.09 | 0.43 | 0.004 | 0.006 | 6.19 | 0.03 |
| 35 | 0.16 | 3.01 | 0.40 | 0.004 | 0.006 | 6.08 | 0.03 |

| Example No. | Chemical Component (Weight %) | | | | | | |
|---|---|---|---|---|---|---|---|
| | W | Co | REM* | Y | Mg | Ca | B |
| 1 | 0.24 | — | — | — | — | — | — |
| 2 | — | 0.15 | — | — | — | — | — |
| 3 | 0.55 | 0.41 | — | — | — | — | — |
| 4 | 1.21 | — | — | — | — | — | — |
| 5 | — | 1.03 | — | — | — | — | — |
| 6 | 1.12 | 0.78 | — | — | — | — | — |
| 7 | 1.95 | — | — | — | — | — | — |
| 8 | — | 1.97 | — | — | — | — | — |
| 9 | 0.79 | 1.18 | — | — | — | — | — |
| 10 | — | — | 0.03 | — | — | — | — |
| 11 | — | — | — | 0.01 | — | — | — |
| 12 | — | — | 0.04 | 0.01 | — | — | — |
| 13 | — | — | — | — | 0.010 | — | — |
| 14 | — | — | — | — | — | 0.013 | — |
| 15 | — | — | — | — | 0.018 | 0.005 | — |
| 16 | — | — | — | — | — | — | 0.003 |
| 17 | — | — | — | — | — | — | 0.008 |
| 18 | 0.50 | — | 0.01 | — | — | — | — |
| 19 | — | 0.82 | — | 0.007 | — | — | — |
| 20 | 0.62 | 0.48 | 0.01 | 0.003 | — | — | — |
| 21 | 0.72 | — | — | — | 0.008 | — | — |
| 22 | — | 1.02 | — | — | — | 0.008 | — |
| 23 | 0.58 | 0.62 | — | — | 0.008 | 0.006 | — |
| 24 | 0.55 | — | — | — | — | — | 0.004 |
| 25 | — | 1.02 | — | — | — | — | 0.008 |
| 26 | 0.50 | 0.48 | — | — | — | — | 0.006 |
| 27 | 1.02 | 0.20 | 0.03 | 0.01 | 0.018 | 0.008 | — |
| 28 | 0.20 | 0.98 | 0.05 | 0.02 | 0.011 | 0.007 | — |
| 29 | 0.50 | 0.48 | 0.03 | 0.01 | 0.007 | 0.008 | — |
| 30 | 1.08 | 0.15 | 0.01 | 0.01 | — | — | 0.005 |
| 31 | 0.18 | 1.32 | 0.02 | 0.02 | — | — | 0.008 |
| 32 | 0.68 | 0.51 | 0.02 | 0.02 | — | — | 0.009 |
| 33 | 0.22 | 0.22 | 0.01 | 0.01 | 0.006 | 0.007 | 0.003 |
| 34 | 0.50 | 0.58 | 0.01 | 0.01 | 0.008 | 0.009 | 0.005 |
| 35 | 0.58 | 0.49 | 0.02 | 0.01 | 0.010 | 0.011 | 0.008 |

TABLE 2

| Comparative Example No. | Chemical Component (Weight %) | | | | | | |
|---|---|---|---|---|---|---|---|
| | C | Si | Mn | P | S | Cr | N |
| 1 | 0.16 | 1.51 | 0.50 | 0.004 | 0.003 | 4.05 | 0.02 |
| 2 | 0.23 | 2.23 | 0.51 | 0.010 | 0.003 | 4.18 | 0.03 |
| 3 | 0.15 | 3.65 | 0.47 | 0.006 | 0.005 | 4.59 | 0.03 |
| 4 | 0.09 | 4.53 | 0.50 | 0.005 | 0.004 | 4.40 | 0.03 |
| 5 | 0.27 | 3.42 | 0.48 | 0.004 | 0.003 | 7.82 | 0.03 |
| 6 | 0.03 | 3.08 | 0.51 | 0.004 | 0.005 | 5.83 | 0.03 |
| 7 | 0.15 | 3.12 | 0.49 | 0.005 | 0.005 | 6.01 | 0.03 |

| Comparative Example No. | Chemical Component (Weight %) | | | | | | |
|---|---|---|---|---|---|---|---|
| | W | Co | REM* | Y | Mg | Ca | B |
| 1 | 0.51 | — | — | — | — | — | — |
| 2 | 0.53 | — | — | — | — | — | — |
| 3 | 0.48 | — | — | — | — | — | — |
| 4 | 0.50 | — | — | — | — | — | — |
| 5 | 0.48 | — | — | — | — | — | — |
| 6 | 0.51 | — | — | — | — | — | — |
| 7 | — | — | — | — | — | — | — |

Note:
*Misch metal consisting of 50% of Ce, 30% of La, 15% of Nd, 4% of Pr, and 1% of Sm.

TABLE 3

| Conventional Example No. | Chemical Component (Weight %) | | | | | |
|---|---|---|---|---|---|---|
| | C | Si | Mn | P | S | Cr |
| 8 | 3.25 | 4.11 | 0.46 | 0.018 | 0.010 | — |
| 9 | 2.86 | 2.58 | 0.85 | 0.015 | 0.006 | 2.46 |
| 10 | 0.44 | 2.26 | 0.31 | 0.013 | 0.004 | 8.31 |
| 11 | 0.03 | 3.04 | 0.41 | 0.004 | 0.003 | 4.95 |
| 12 | 0.15 | 3.18 | 0.52 | 0.004 | 0.003 | 5.16 |

| Conventional Example No. | Chemical Component (Weight %) | | | | |
|---|---|---|---|---|---|
| | Mo | Nb | Ti | Ni | Mg |
| 8 | — | — | — | — | 0.044 |
| 9 | — | — | — | 20.9 | 0.085 |
| 10 | — | — | — | — | — |
| 11 | — | 0.29 | 0.15 | — | — |
| 12 | — | 0.57 | 0.16 | — | — |

By using each test piece prepared by the above method, the following evaluation tests were conducted.

First, to analyze factors controlling a thermal fatigue life, solid, rod-shaped test pieces each having a diameter of 10 mm and a length of 20 mm were used, and subjected to an oxidation test by exposing them to the air at 900° C. for 200 hours. In the oxidation test, an oxide scale formed on the surface of the test piece was removed by a sand blasting treatment to measure a weight variation per a unit surface area. By calculating an oxidation weight loss ($g/cm^2$) after the oxidation test, the oxidation resistance was evaluated.

Also, for the examination of tensile properties, a tensile test was conducted both at a room temperature and at a high temperature. For the tensile test at a room temperature, a No. 4 standard tensile-test piece according to JIS Z 2201 was employed. For the tensile test at a high temperature, a flanged test piece having a gauge diameter of 10 mm and a gauge distance of 50 mm defined in JIS G 0567 was employed, and the test was conducted at 850° C.

Also, a thermal expansion was measured on a test piece having a diameter of 3 mm and a length of 10 mm by heating in vacuum, to investigate a transformation point, which is known to make the heat deformation resistance low if it falls in the range of a usual operation temperature for exhaust parts. Also, by using a test piece having a U-notch (No. 3 test piece according to JIS), the impact test was conducted at a room temperature.

Furthermore, since exhaust equipment members are subjected to great thermal fatigue, when used in a state where a thermal expansion and a thermal contraction are restrained in heating and cooling cycles, it is primarily important that the heat-resistant cast iron used for exhaust equipment members is highly resistant to cracking and deformation by the thermal fatigue. Therefore, by using an electric-hydraulic servo-type thermal fatigue test machine, a thermal fatigue life was measured on each test piece.

For the thermal fatigue test, a rod-shaped test piece having a gauge distance of 20 mm and a gauge diameter of 10 mm was subjected to a heating and cooling cycle, by controlling a high-frequency coil output and a cooling-air jet. The expansion and contraction of the test piece caused by the heating and cooling were completely restrained mechanically by using an extensometer. In this case, a phase of a temperature variation and a phase of a strain variation have an inverse relationship. Conditions of heating and cooling are as follows:

Lowest temperature: 150° C.
Highest temperature: 900° C.
Heating time to the highest temperature: 2 minutes.
Heating time at the highest temperature: 1 minute.
Cooling time to the lowest temperature: 4 minutes.
Each cycle of the above temperature variation: 7 minutes.

Incidentally, a thermal fatigue life was defined as the number of whichever earlier cycles, until when the test piece was broken, or until when a tensile load decreased to 75% of that of the test piece at the lowest temperature after 2 cycles due to the necking of the test piece.

Figure 2:
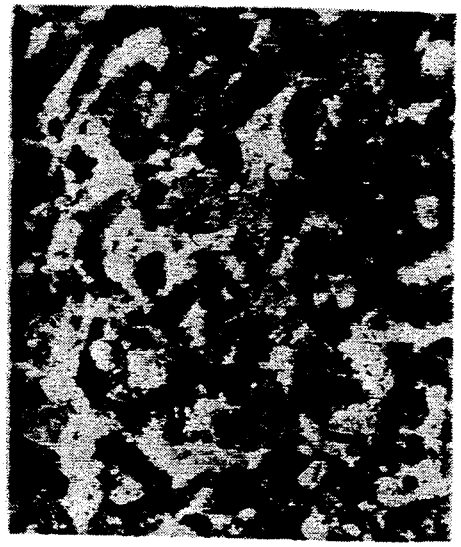
FIG. 2 is a photomicrograph (100×) showing a metal matrix in an as-cast state of the heat-resistant cast steel of Example 7 shown in Table 1.

With respect to Examples (the present invention), Comparative Examples and Conventional Examples, Table 4 shows the results of a matrix structure observation in an as-cast state, an oxidation test, a tensile test, a transformation temperature analysis, a Charpy impact test, and a thermal fatigue test. Since the test pieces of the present invention shown in Table 4 have a colony-phase area ratio defined by a colony-phase area/(a ferrite-phase area + a colony-phase area) of 15–90%, they have excellent heat resistance. Typical as-cast matrix structures of the test pieces of the present invention are shown in photomicrographs (100×) in FIGS. 1 and 2. FIG. 1 is a photomicrograph of Example 2 having a colony-phase area ratio of about 30%, and FIG. 2 is a photomicrograph of Example 7 having a colony-phase area ratio of about 90%.

Figure 3:
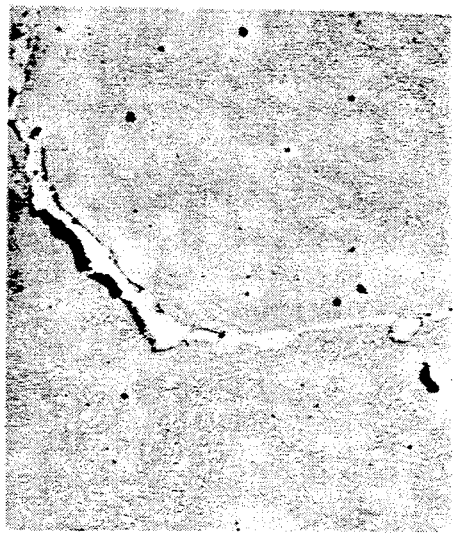
FIG. 3 is a photomicrograph (100×) showing a metal matrix in an as-cast state of the heat-resistant cast steel of Comparative Example 1 shown in Table 2.

An as-cast matrix of Comparative Example 1 is shown in FIG. 3. It is shown that a nearly whole area of the matrix of the as-cast test piece of Comparative Example 1 has a hard sorbitic structure. This is because the amount of Si having a function of expanding a ferrite phase is too small relative to the amount of C. Since a sorbitic structure is hard, the test piece of Comparative Example 1 is brittle and its machining is carried out with much difficulty. Obviously, if the test piece is annealed at a temperature of 850°–900° C., the sorbite would be decomposed to a ferrite phase and carbide particles. However, since a heat treatment costs a lot and causes a high heat strain on very thin parts, it is not preferable that there exists a sorbitic metal matrix in an as-cast state.

Also, for the comparison of oxidation resistance, a heat treatment comprising the steps of heating at 920° C. for 2 hours in a furnace, cooling to 800° C. in a furnace, and spontaneously cooling in the air was conducted on the test pieces of Comparative Examples. The test piece of Comparative Example 1 has very poor oxidation resistance compared to the test piece of the present invention, because the amount of si in Comparative Example 1 is much smaller than that of the test piece of the present invention. In addition, a nearly whole area of a metal matrix in an as-cast state of Comparative Example 2 showed a hard sorbitic structure like the test piece of Comparative Example 1. This is also because the amount of Si having a function of forming a ferrite phase is too small relative to the amount of C in Comparative Example 2.

To examine various properties in case where the amount of Si exceeded 3.5 weight %, the test pieces of Comparative Example 3 and 4 were used. Both had a mixed structure of a ferrite phase and a pearlitic-colony phase in a metal matrix in an as-cast state. However, since the amount of Si is excessive, the elongation of each test piece is small and there is almost no elongation at a room temperature as shown in Table 4. Accordingly, it was impossible to measure a 0.2-%-yield strength.

Figure 4:
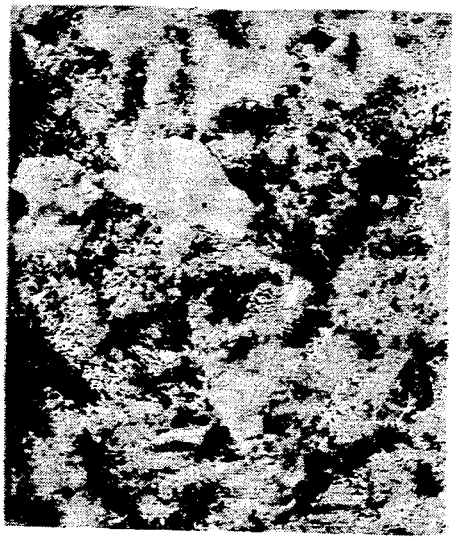
FIG. 4 is a photomicrograph (100×) showing a metal matrix in an as-cast state of the heat-resistant cast steel of Comparative Example 5 shown in Table 2.

A metal matrix in an as-cast state of Comparative Example 5 is shown in FIG. 4. Like Comparative Examples 1 and 2, the test piece of Comparative Example 5 had a hard sorbitic structure almost over the entire metal matrix. This is for the reason similar to Comparative Examples 1 and 2; that is, the amount of Si having a function of forming a ferrite phase is too small relative to the amount of C.

To measure various properties in case where the amount of C was less than 0.05 weight %, the test piece of Comparative Example 6 was used. Although a metal matrix in an as-cast state was a mixture of a ferrite phase and a pearlitic-colony phase, a colony area ratio was 10% or less due to the existence of C in an amount of 0.03 weight %, and the test piece of Comparative Example 6 had an inferior thermal fatigue life compared to the test pieces of the present invention. Also, the test piece of Comparative Example 6 had poor tensile properties, which are essential for the improvement of heat deformation resistance, compared to the test pieces of the present invention.

The test piece of Comparative Example 7 was used to measure various properties in case where none of W, Co and B, effective for improving tensile properties, was contained. Although a metal matrix in an as-cast state of Comparative Example 7 was a mixture of a ferrite phase and a pearlitic-colony phase, the tensile strength was low and thus the thermal fatigue life was short compared to the test pieces containing W, Co, and B according to one embodiment of the present invention.

Next, with respect to the test pieces of Conventional Examples 8 and 9, oxidation resistance and thermal fatigue property are extremely poorer than the test pieces of the present invention. Thus, the cast irons of Conventional Examples 8 and 9 are not suitable for parts at which the present invention are aimed.

Also, since the test piece of Conventional Example 10 had a higher-C and lower-Si composition, compared to the test pieces of the present invention, it had a sorbitic matrix in an as-cast state and a lower transformation point compared to the test pieces of the present invention. Also, it had poor oxidation resistance and thermal fatigue property, which are required to be good for exhaust equipment members. Furthermore, since the test pieces of Conventional Examples 11 and 12 contained Nb and Ti, which inhibit a perlitic-colony phase from being formed, almost a whole matrix in an as-cast state is composed of a ferrite phase, making their tensile properties and thermal fatigue properties poorer compared to those of the test pieces of the present invention.

The test pieces of the present invention shown in Table 4 have colony area ratios of about 15–90%, defined as an area of a colony phase/(a ferrite phase area + a colony phase area). It turned out as a result of evaluation of all properties that the test pieces of the present invention were excellent in various properties which are needed for exhaust equipment members. Since the test pieces of the present invention have much better thermal fatigue properties than the test pieces of any Comparative Examples, the heat-resistant cast steel of the present invention is excellent in heat deformation resistance and thermal crack resistance, both of which are particularly important for exhaust equipment members.

TABLE 4

| No. | Metal Matrix(1) | Weight Loss by Oxidation(2) | Transformation Point (°C.) | Charpy Impact Value (J/cm²) | Thermal Fatigue Life(3) |
|---|---|---|---|---|---|
| Example | | | | | |
| 1 | ○ | 0.0022 | ≧1000 | 3.0 | 251 |
| 2 | ○ | 0.0019 | ≧1000 | 3.0 | 265 |
| 3 | ○ | 0.0020 | ≧1000 | 4.2 | 304 |
| 4 | ○ | 0.0016 | ≧1000 | 5.0 | 454 |
| 5 | ○ | 0.0017 | ≧1000 | 4.2 | 488 |
| 6 | ○ | 0.0015 | ≧1000 | 3.0 | 495 |
| 7 | ○ | 0.0013 | ≧1000 | 2.7 | 502 |
| 8 | ○ | 0.0015 | ≧1000 | 2.7 | 551 |
| 9 | ○ | 0.0014 | ≧1000 | 2.7 | 563 |
| 10 | ○ | 0.0012 | 952 | 6.3 | 354 |
| 11 | ○ | 0.0011 | 965 | 5.0 | 316 |
| 12 | ○ | 0.0010 | 970 | 3.7 | 385 |
| 13 | ○ | 0.0017 | 960 | 4.2 | 337 |
| 14 | ○ | 0.0017 | 970 | 3.7 | 349 |
| 15 | ○ | 0.0016 | 950 | 3.2 | 311 |
| 16 | ○ | 0.0018 | 965 | 4.2 | 325 |
| 17 | ○ | 0.0017 | 955 | 3.5 | 385 |
| 18 | ○ | 0.0011 | ≧1000 | 2.7 | 465 |
| 19 | ○ | 0.0012 | 975 | 3.0 | 428 |
| 20 | ○ | 0.0010 | ≧1000 | 2.7 | 486 |
| 21 | ○ | 0.0019 | ≧1000 | 2.7 | 506 |
| 22 | ○ | 0.0020 | 985 | 2.7 | 498 |
| 23 | ○ | 0.0017 | ≧1000 | 3.0 | 457 |
| 24 | ○ | 0.0017 | 985 | 3.0 | 425 |
| 25 | ○ | 0.0017 | ≧1000 | 2.7 | 592 |
| 26 | ○ | 0.0018 | ≧1000 | 4.2 | 558 |
| 27 | ○ | 0.0012 | 980 | 2.7 | 540 |
| 28 | ○ | 0.0012 | ≧1000 | 3.0 | 497 |
| 29 | ○ | 0.0010 | ≧1000 | 4.2 | 614 |
| 30 | ○ | 0.0011 | 978 | 6.3 | 588 |
| 31 | ○ | 0.0010 | ≧1000 | 2.7 | 582 |
| 32 | ○ | 0.0010 | ≧1000 | 3.0 | 601 |
| 33 | ○ | 0.0009 | 965 | 2.7 | 657 |
| 34 | ○ | 0.0011 | 985 | 3.0 | 602 |
| 35 | ○ | 0.0012 | 980 | 2.7 | 624 |
| Comparative Example | | | | | |
| 1 | X | 0.238 | — | — | — |
| 2 | X | 0.0044 | — | — | — |
| 3 | ○ | 0.0014 | — | 2.3 | 355 |
| 4 | ○ | 0.0018 | — | 2.1 | 201 |
| 5 | X | 0.0021 | — | — | — |
| 6 | Δ | 0.0014 | — | 3.5 | 183 |
| 7 | ○ | 0.0021 | — | 3.0 | 191 |
| Conventional Example | | | | | |
| 8 | *(4) | 0.185 | 805 | 2.0 | 34 |
| 9 | **(5) | 0.137 | nil | 15.0 | 15 |
| 10 | X | 0.0054 | 885 | 4.3 | 157 |
| 11 | Δ | 0.0015 | ≧1000 | 4.5 | 163 |
| 12 | Δ | 0.0018 | ≧1000 | 4.0 | 172 |

| Example No. | Tensile properties at Room Temperature(6): 0.2-% Offset Yield Strength | Tensile Strength | Elongation | Hardness |
|---|---|---|---|---|
| 1 | 420 | 450 | 1.8 | 207 |
| 2 | 445 | 470 | 1.5 | 217 |
| 3 | 460 | 490 | 2.0 | 207 |
| 4 | 440 | 505 | 2.2 | 217 |
| 5 | 460 | 510 | 1.3 | 217 |
| 6 | 490 | 520 | 1.3 | 223 |
| 7 | 535 | 545 | 1.0 | 241 |
| 8 | 520 | 545 | 1.5 | 241 |
| 9 | 520 | 550 | 1.6 | 241 |
| 10 | 430 | 505 | 3.1 | 212 |
| 11 | 435 | 510 | 2.5 | 217 |
| 12 | 420 | 500 | 2.0 | 223 |
| 13 | 445 | 485 | 1.2 | 212 |
| 14 | 435 | 495 | 1.3 | 223 |
| 15 | 425 | 505 | 2.0 | 217 |
| 16 | 450 | 505 | 2.2 | 217 |

TABLE 4-continued

| | | | | |
|---|---|---|---|---|
| 17 | 455 | 490 | 1.9 | 229 |
| 18 | 435 | 510 | 1.3 | 223 |
| 19 | 425 | 485 | 2.0 | 217 |
| 20 | 450 | 495 | 1.5 | 241 |
| 21 | 490 | 520 | 1.3 | 223 |
| 22 | 480 | 510 | 1.4 | 229 |
| 23 | 505 | 530 | 1.8 | 241 |
| 24 | 520 | 540 | 2.0 | 241 |
| 25 | 535 | 550 | 1.8 | 241 |
| 26 | 540 | 535 | 2.2 | 232 |
| 27 | 495 | 520 | 1.3 | 223 |
| 28 | 480 | 525 | 2.0 | 223 |
| 29 | 490 | 515 | 2.2 | 223 |
| 30 | 455 | 505 | 2.8 | 212 |
| 31 | 470 | 520 | 1.8 | 217 |
| 32 | 485 | 535 | 2.3 | 223 |
| 33 | 505 | 530 | 1.3 | 241 |
| 34 | 500 | 520 | 1.8 | 241 |
| 35 | 495 | 505 | 1.2 | 241 |

| Example No. | Tensile properties at 850° C.(6): 0.2-% Offset Yield Strength | Tensile Strength | Elongation |
|---|---|---|---|
| 1 | 20 | 29 | 79 |
| 2 | 22 | 32 | 102 |
| 3 | 24 | 30 | 78 |
| 4 | 27 | 35 | 50 |
| 5 | 26 | 36 | 48 |
| 6 | 28 | 39 | 70 |
| 7 | 30 | 39 | 48 |
| 8 | 30 | 41 | 55 |
| 9 | 31 | 43 | 54 |
| 10 | 17 | 26 | 73 |
| 11 | 17 | 26 | 92 |
| 12 | 18 | 26 | 70 |
| 13 | 18 | 27 | 81 |
| 14 | 20 | 29 | 79 |
| 15 | 21 | 29 | 98 |
| 16 | 22 | 29 | 67 |
| 17 | 22 | 31 | 86 |
| 18 | 27 | 36 | 50 |
| 19 | 28 | 40 | 68 |
| 20 | 30 | 41 | 52 |
| 21 | 29 | 38 | 55 |
| 22 | 28 | 39 | 65 |
| 23 | 31 | 40 | 48 |
| 24 | 28 | 40 | 60 |
| 25 | 27 | 39 | 66 |
| 26 | 29 | 41 | 58 |
| 27 | 31 | 41 | 70 |
| 28 | 31 | 39 | 52 |
| 29 | 30 | 42 | 80 |
| 30 | 31 | 43 | 62 |
| 31 | 30 | 41 | 58 |
| 32 | 31 | 43 | 70 |
| 33 | 32 | 41 | 55 |
| 34 | 30 | 39 | 65 |
| 35 | 31 | 43 | 72 |

| No. | Tensile properties at Room Temperature(6): 0.2-% Offset Yield Strength | Tensile Strength | Elongation | Hardness |
|---|---|---|---|---|
| Comparative Example | | | | |
| 1 | — | — | — | 321 |
| 2 | — | — | — | 285 |
| 3 | —(7) | 450 | 0.2 | 248 |
| 4 | —(7) | 430 | 0 | 255 |
| 5 | — | — | — | 311 |
| 6 | 385 | 465 | 3.3 | 187 |
| 7 | 415 | 440 | 2.1 | 212 |
| Conventional Example | | | | |
| 8 | 510 | 635 | 11.0 | 217 |
| 9 | 230 | 455 | 16.3 | 170 |
| 10 | 400 | 726 | 14.1 | 211 |
| 11 | 435 | 500 | 3.1 | 170 |
| 12 | 450 | 530 | 1.5 | 192 |

| | Tensile properties at 850° C.(6): 0.2-% Offset | Tensile |
|---|---|---|

TABLE 4-continued

| No. | Yield Strength | Strength | Elongation |
|---|---|---|---|
| Comparative Example | | | |
| 1 | — | — | — |
| 2 | — | — | — |
| 3 | 19 | 29 | 67 |
| 4 | 17 | 28 | 55 |
| 5 | — | — | — |
| 6 | 14 | 25 | 84 |
| 7 | 17 | 26 | 78 |
| Conventional Example | | | |
| 8 | 21 | 32 | 45 |
| 9 | 75 | 105 | 20 |
| 10 | 36 | 50 | 64 |
| 11 | 14 | 25 | 100 |
| 12 | 16 | 27 | 85 |

Note:
(1)A matrix in an as-cast state was categorized as follows:
○: Ferrite phase + colony phase,
Δ: Ferrite phase + colony phase (Almost all is composed of ferrite phase), and
X: Almost sorbite phase.
(2)Unit is g/cm$^2$.
(3)Unit is the number of cycles.
(4)Ferrite phase + pearlitic phase + graphite.
(5)Austenite phase + graphite.
(6)A unit of each tensile test is as follows:
(a): 0.2% yield strength: N/mm$^2$,
(b): Tensile strength: N/mm$^2$,
(c): Elongation: %, and
(d): Hardness: $H_B$.
(7)Unmeasurable.

Figure 5:
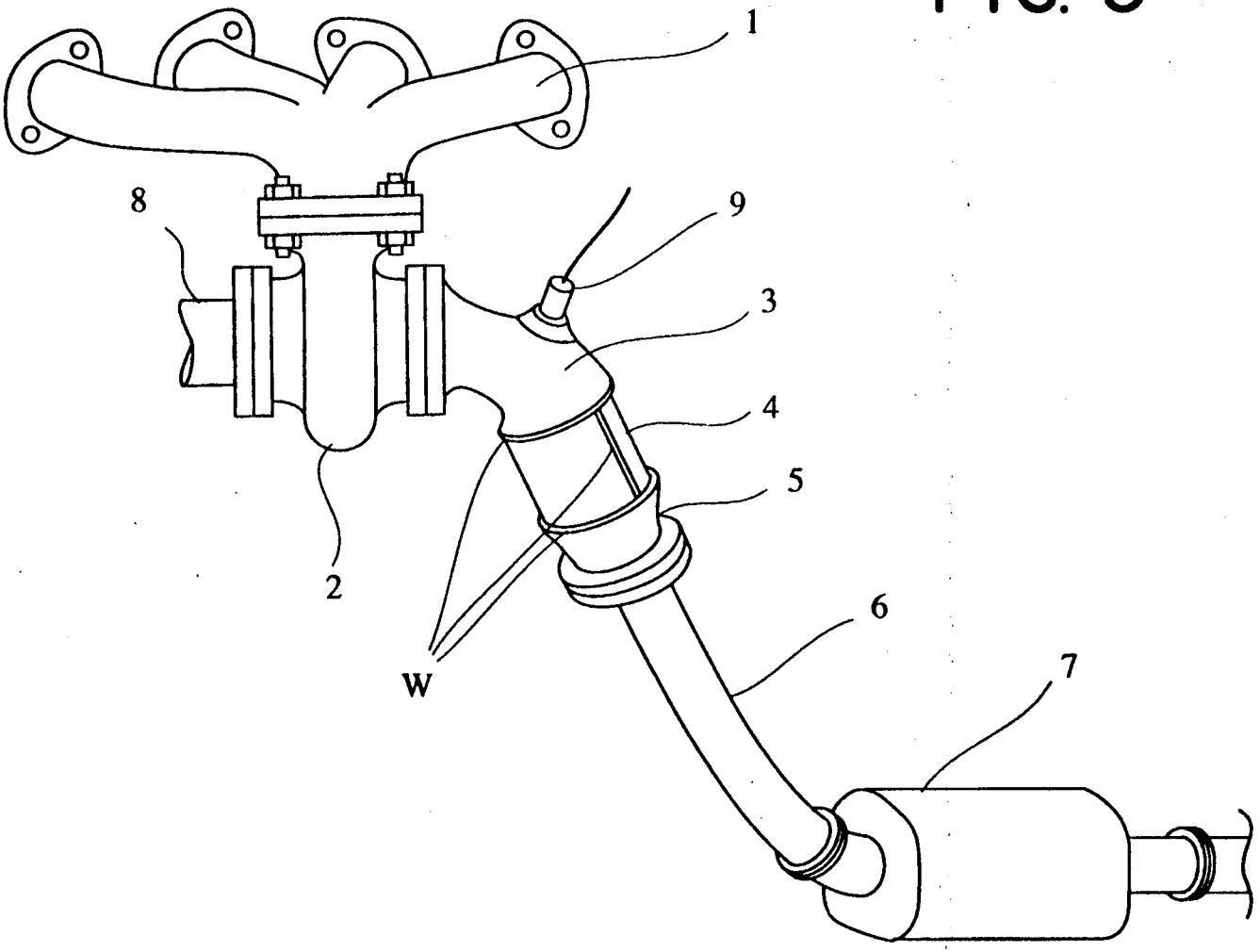
FIG. 5 is a cross-sectional view schematically showing an exhaust equipment member comprising an exhaust manifold, a turbocharger housing, an exhaust outlet and a flange part each made of the heat-resistant cast steel of the present invention, and a secondary catalytic converter, all of which are welded to each other.

Under the conditions shown in Table 5, parts as shown in FIG. 5, namely an integral exhaust manifold 1 (heat-resistant cast steel product A) having a general thickness of 2.5–3.4 mm for a straight-type four-cylinder engine with a supercharger, a turbocharger housing 2 (heat-resistant cast steel product B) having a general thickness of 2.7–4.1 mm for a straight-type four-cylinder engine, an exhaust outlet parts 3 (heat-resistant cast steel product C) having a general thickness of 2.3–2.8 mm, and a flange part 5 (heat-resistant cast steel product D) having a general thickness of 2.3–2.8 mm were produced by casting. Also, as shown in FIG. 6, a pipe-gathering part (heat-resistant cast steel product E) 10 of a welded exhaust manifold 1 having a general thickness of 2.3–2.8 mm for another straight-type four-cylinder engine, and a welded flange part 5 (heat-resistant cast steel product F) having a general thickness of 2.3–2.8 mm were produced by casting.

Incidentally, in FIG. 5, other reference numerals denote the following parts:

4: Secondary catalytic converter container constituted by a rolled stainless steel sheet (SUS430),
6: Exhaust pipe,
7: Primary catalytic converter container,
8: Center housing, and
9: Oxygen sensor.
W: Portions of the secondary catalytic converter container welded to the exhaust outlet 3 and the flange part 5.

Figure 6:
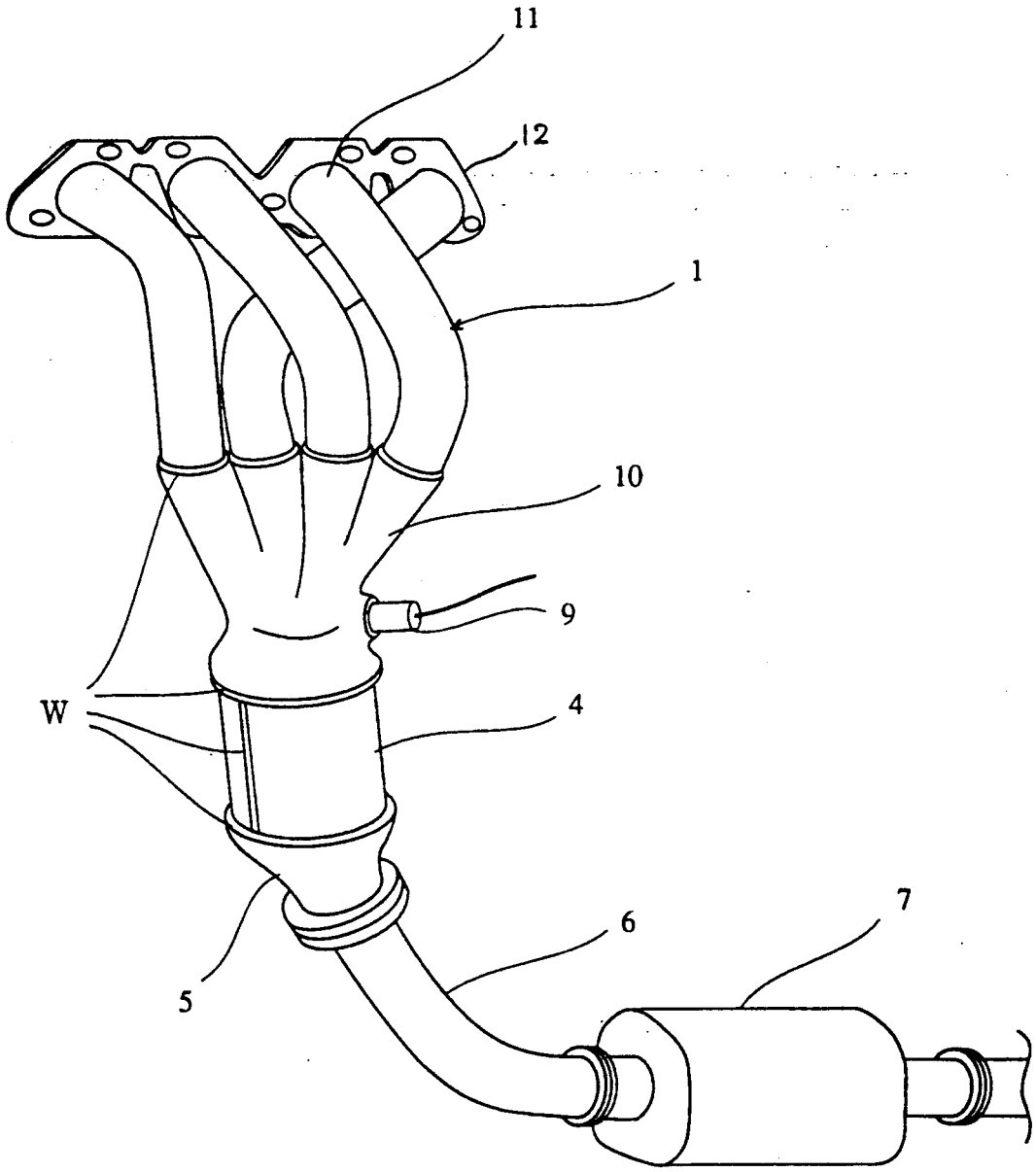
FIG. 6 is a cross-sectional view schematically showing an exhaust equipment member comprising a pipe-gathering portion of a welded exhaust manifold and a welded flange part each made of the heat-resistant cast steel of the present invention, and a secondary catalytic converter, all of which are welded to each other.

Also, in FIG. 6, other reference numerals denote the following parts:

4: Secondary catalytic converter container made of SUS430,
6: Exhaust pipe,
7: Primary catalytic converter container,
9: Oxygen sensor,
11: Pipe of SUS430 welded to the pipe-gathering part 10 of the exhaust manifold 1,
12: Flange part made of SUS430, and
W: Welded portions.

TABLE 5

| | Casting Conditions | | | | Chemical Component (Weight %) | | | | | | | | | |
|---|---|---|---|---|---|---|---|---|---|---|---|---|---|---|
| | Product | Number of Cast Products | Type of Mold | Reduced Pressure | C | Si | Mn | P | S | Cr | N | W | Co | B |
| | A, C, D | 6 each | Sand Mold | 28 kPa | 0.11 | 2.95 | 0.47 | 0.006 | 0.005 | 6.14 | 0.02 | 0.41 | — | — |
| | B | 5 | Sand Mold | 15 kPa | 0.16 | 3.08 | 0.51 | 0.005 | 0.005 | 6.81 | 0.03 | 0.55 | 0.34 | 0.002 |
| | E, F | 10 each | Sand Mold | 35 kPa | 0.08 | 2.99 | 0.48 | 0.004 | 0.005 | 4.89 | 0.03 | 0.28 | — | — |

As a result of examination on the productivity of these cast products, it was found that good cast parts were obtained under any conditions according to the present invention. In addition, these cast parts were machined to examine their cuttability. As a result, no problems were found in any cast parts.

Products C and D were welded to the secondary catalytic converter container 4 constituted by a 2-mm-thick rolled stainless steel sheet made of SUS430, to provide an exhaust outlet having an integrally welded secondary catalytic converter (refer to FIG. 5). Also, Products E and F were welded to the pipes of 2 mm in thickness and 40 mm in inside diameter made of SUS430 and to the secondary catalytic converter container 4 of a 2-mm-thick rolled stainless steel sheet made of SUS430, to provide an exhaust manifold having an integrally welded secondary catalytic converter (refer to FIG. 6). The welding was done using an MIG-type welding machine and an argon gas as a sealing gas. Also, a welding wire of 0.8 mm in diameter made of a stainless steel equivalent to SUS430 containing 0.01 weight % or less of C was used. As a result, it was confirmed that all of the four products having welded structures made of the cast steel of the present invention were well welded to the stainless steel pipes and the rolled sheets both made of SUS430. Accordingly, it can be concluded that the cast steel of the present invention has sufficiently reliable weldability to stainless steel parts, as a material for integrally welded heat-resistant exhaust equipment members.

Next, the exhaust manifold 1 (Product A), the turbocharger housing 2 (Product B), and the exhaust outlet 3 (Product C) welded to the secondary catalytic converter 4 and the flange part 5 (Product D) were mounted to a real high-performance straight-type, four-cylinder, 2000-cc gasoline engine to conduct a durability test. The test was conducted by repeating 500 heating-cooling (Go-Stop) cycles each consisting of a continuous full-load operation at 6000 rpm (14 minutes), idling (1 minute), complete stop (14 minutes), and idling (1 minute) in this order. The temperature of exhaust gas at a full-load operation was 930° C. at the inlet of the turbocharger housing 2. In such conditions, the maximum surface temperature of the exhaust manifold 1 was about 870° C. in a pipe-gathering portion thereof and the maximum surface temperature of the turbocharger housing 2 was about 890° C. in a waist gate portion thereof. As a result of the evaluation test, no gas leak and thermal cracking were observed. It was thus confirmed that these parts made of the heat-resistant cast steel of the present invention had excellent durability and reliability.

On the other hand, as shown in Table 6, an exhaust manifold having a shape similar to Product A was produced from a high-Si spheroidal graphite cast steel, and a turbocharger housing having a shape similar to Product B was produced from an austenite spheroidal graphite cast steel (NI-RESIST D2, trademark of INCO). The exhaust manifold and the turbocharger housing were mounted to the same engine as above to conduct a durability test under the same conditions as above. In this test, the exhaust outlet consisting of the secondary catalytic converter and Product C and Product D welded thereto was also mounted to the exit end of the turbocharger housing.

As a result of the evaluation test, a thermal crack occurred in the exhaust manifold made of the high-Si spheroidal graphite cast steel near the pipe-gathering portion thereof due to oxidation and thermal fatigue after 98 cycles, so that the exhaust manifold became unusable. Thereafter, the exhaust manifold was replaced by Product A for further testing. Then, a thermal crack penetrating the thickness of the turbocharger housing occurred in the "scroll" portion of the turbocharger housing after 2183 cycles. On the other hand, no problem was found in the exhaust outlet having the secondary catalytic converter.

TABLE 6

| Product | Casting Conditions: Number of Cast Products | Type of Mold | Reduced Pressure | Chemical Component (Weight %): C | Si | Mn | P | S | Cr | Ni | Mo | Mg |
|---|---|---|---|---|---|---|---|---|---|---|---|---|
| Exhaust Manifold(1) | 2 | Sand Mold | 15 kPa | 3.15 | 3.95 | 0.47 | 0.024 | 0.008 | 0.03 | — | 0.55 | 0.048 |
| Turbocharger Housing(2) | 2 | Sand Mold | 10 kPa | 2.91 | 2.61 | 0.81 | 0.018 | 0.010 | 2.57 | 21.5 | — | 0.084 |

Note:
(1)Made of high-Si spheroidal graphite cast iron and having a shape similar to Product A.
(2)Made of austenite spheroidal graphite cast iron and having a shape similar to Product B.

As a result of the above tests, it is verified that the exhaust manifold and the turbocharger housing of the present invention have excellent heat resistance.

Furthermore, an integrally welded exhaust manifold having a secondary catalytic converter welded to Product E and Product F of the present invention was mounted to a real straight-type, four-cylinder, 1800-cc gasoline engine of an uncontrolled air intake-type, to conduct a durability test. The test was conducted by repeating 500 heating-cooling (Go-Stop) cycles each consisting of a continuous full-load operation at 6400 rpm (14 minutes), idling (1 minute), complete stop (14 minutes), and idling (1 minute) in this order. The temperature of exhaust gas at a full-load operation was 910° C. at the outlet of the exhaust manifold. The maximum surface temperature of the exhaust manifold was 840° C. in the pipe-gathering portion where Product E was used. In this test, no problem was found in the integrally welded exhaust manifold having a secondary catalytic converter, either.

As described above in detail, since the heat-resistant cast steel of the present invention has much more excellent oxidation resistance, thermal crack resistance, and heat deformation resistance, which are especially important to exhaust equipment members, than those of the conventional heat-resistant cast iron or steel, it can be suitably used for parts exposed to a combustion gas or an exhaust gas of an internalcombustion engine. Also, since the heat-resistant cast steel of the present invention has castability, workability, and welding reliability equivalent to those of the conventional heat-resistant ferritic cast steel, its cast articles can be produced at low costs.

What is claimed is:

1. A heat-resistant cast steel having a metal matrix substantially consisting of a ferrite phase and a pearlitic-colony phase and having a composition consisting essentially, by weight, of:
C: 0.05–0.25%,
Si: 2.5–3.5%,
Mn: 2% or less,
Cr: 4–8%,
N: 0.05% or less,
W and/or Co: 0.1–2%, and
Fe and inevitable impurities: balance.

2. A heat-resistant cast steel having a metal matrix substantially consisting of a ferrite phase and a pearlitic-colony phase and having a composition consisting essentially, by weight, of:
C: 0.05–0.25%,
Si: 2.5–3.5%,
Mn: 2% or less,
Cr: 4–8%,
N: 0.05% or less,
Rare earth element and/or Y: 0.1% or less, and
Fe and inevitable impurities: balance.

3. A heat-resistant cast steel having a metal matrix substantially consisting of a ferrite phase and a pearlitic-colony phase and having a composition consisting essentially, by weight, of:
C: 0.05–0.25%,
Si: 2.5–3.5%,
Mn: 2% or less,
Cr: 4–8%,
N: 0.05% or less,
Mg and/or Ca: 0.005–0.03%, and
Fe and inevitable impurities: balance.

4. A heat-resistant cast steel having a metal matrix substantially consisting of a ferrite phase and a pearlitic-colony phase and having a composition consisting essentially, by weight, of:
C: 0.05–0.25%,
Si: 2.5–3.5%,
Mn: 2% or less,
Cr: 4–8%,
N: 0.05% or less,
B: 0.001–0.01%, and
Fe and inevitable impurities: balance.

5. A heat-resistant cast steel having a metal matrix substantially consisting of a ferrite phase and a pearlitic-colony phase and having a composition consisting essentially, by weight, of:
C: 0.05–0.25%,
Si: 2.5–3.5%,
Mn: 2% or less, Cr: 4–8%,
N: 0.05% or less,
W and/or Co: 0.1–2%,
Rare earth element and/or Y: 0.1% or less, and
Fe and inevitable impurities: balance.

6. A heat-resistant cast steel having a metal matrix substantially consisting of a ferrite phase and a pearlitic-colony phase and having a composition consisting essentially, by weight, of:
C: 0.05–0.25%,
Si: 2.5–3.5%,
Mn: 2% or less,
Cr: 4–8%,
N: 0.05% or less,
W and/or Ca: 0.1–2%,
Mg and/or Ca: 0.005–0.03%, and
Fe and inevitable impurities: balance.

7. A heat-resistant cast steel having a metal matrix substantially consisting of a ferrite phase and a pearlitic-colony phase and having a composition consisting essentially, by weight, of:
C: 0.05–0.25%,
Si: 2.5–3.5%,
Mn: 2% or less,
Cr: 4–8%,
N: 0.05% or less,
W and/or Co: 0.1–2%,
B: 0.001–0.01%, and
Fe and inevitable impurities: balance.

8. A heat-resistant cast steel having a metal matrix substantially consisting of a ferrite phase and a pearlitic-colony phase and having a composition consisting essentially, by weight, of:
C: 0.05–0.25%,
Si: 2.5–3.5%,
Mn: 2% or less,
Cr: 4–8%,
N: 0.05% or less,
W and/or Co: 0.1–2%,
Rare earth element and/or Y: 0.1% or less,
Mg and/or Ca: 0.005–0.03%, and
Fe and inevitable impurities: balance.

9. A heat-resistant cast steel having a metal matrix substantially consisting of a ferrite phase and a pearlitic-colony phase and having a composition consisting essentially, by weight, of:
C: 0.05–0.25%,
Si: 2.5–3.5%,
Mn: 2% or less,
Cr: 4–8%,
N: 0.05% or less,
W and/or Co: 0.1–2%,
Rare earth element and/or Y: 0.1% or less,
B: 0.001–0.01%, and
Fe and inevitable impurities: balance.

10. A heat-resistant cast steel having a metal matrix substantially consisting of a ferrite phase and a ferrite phase and having a composition consisting essentially, by weight, of:
C: 0.05–0.25%,
Si: 2.5–3.5%,
Mn: 2% or less,
Cr: 4–8%,
N: 0.05% or less,
W and/or Co: 0.1–2%,
Rare earth element and/or Y: 0.1% or less,
Mg and/or Ca: 0.005–0.03%,
B: 0.001–0.01%, and
Fe and inevitable impurities: balance.

11. The heat-resistant cast steel according to claim 1, wherein the pearlitic-colony phase has a eutectoid structure of a metal-carbon compound and a ferrite.

12. The heat-resistant cast steel according to claim 2, wherein the pearlitic-colony phase has a eutectoid structure of a metal-carbon compound and a ferrite.

13. The heat-resistant cast steel according to claim 3, wherein the pearlitic-colony phase has a eutectoid structure of a metal-carbon compound and a ferrite.

14. The heat-resistant cast steel according to claim 4, wherein the pearlitic-colony phase has a eutectoid structure of a metal-carbon compound and a ferrite.

15. The heat-resistant cast steel according to claim 5, wherein the pearlitic-colony phase has a eutectoid structure of a metal-carbon compound and a ferrite.

16. The heat-resistant cast steel according to claim 6, wherein the pearlitic-colony phase has a eutectoid structure of a metal-carbon compound and a ferrite.

17. The heat-resistant cast steel according to claim 7, wherein the pearlitic-colony phase has a eutectoid structure of a metal-carbon compound and a ferrite.

18. The heat-resistant cast steel according to claim 8, wherein the pearlitic-colony phase has a eutectoid structure of a metal-carbon compound and a ferrite.

19. The heat-resistant cast steel according to claim 9, wherein the pearlitic-colony phase has a eutectoid structure of a metal-carbon compound and a ferrite.

20. The heat-resistant cast steel according to claim 10, wherein the pearlitic-colony phase has a eutectoid structure of a metal-carbon compound and a ferrite.

21. A process for making the heat-resistant cast steel according to claim 1, wherein a molten metal having the above composition after solidification is poured into a sand mold under reduced pressure or into a precision casting mold, cooled off spontaneously in the mold until the temperature of the hottest part of the cast product gets down to 900° C. or lower, and then shaken out of the mold.

22. The process according to claim 21, wherein the ascast steel is reheated to 800°–900° C. for 30–600 minutes after shake-out, and then cooled off spontaneously.

23. An exhaust equipment member exposed to hot combustion gas or exhaust gas, a whole part of which is integrally made of the heat-resistant cast steel according to claim 1.

24. An exhaust equipment member exposed to hot combustion gas or exhaust gas, a part of which is made of the heat-resistant cast steel according to claim 1.

25. The exhaust equipment member according to claim 24, comprising a first part made of the heat-resistant cast steel and a second part constituted by a welded stainless steel sheet, said first and second parts being welded integrally.

26. The exhaust equipment member according to claim 24, comprising an exhaust manifold made of the heat-resistant cast steel, which is welded to a catalytic container constituted by a welded stainless steel sheet.

27. The exhaust equipment member according to claim 25, comprising an exhaust manifold made of the heat-resistant cast steel, which is welded to a catalytic container constituted by a welded stainless steel sheet.

* * * * *

UNITED STATES PATENT AND TRADEMARK OFFICE

CERTIFICATE OF CORRECTION

PATENT NO. : 5,201,965
DATED : April 13, 1993
INVENTOR(S) : Koki Ohtsuka et al.

It is certified that error appears in the above-identified patent and that said Letters Patent is hereby corrected as shown below:

Claim 10, column 23, line 58, "a ferrite" (second occurrence) should read --a pearlitic-colony--.

Claim 21, column 24, line 44, "ascast" should read --as-cast--.

Signed and Sealed this

Fourteenth Day of June, 1994

*Attest:*

*Attesting Officer*

Bruce Lehman

BRUCE LEHMAN

*Commissioner of Patents and Trademarks*